US009547259B2

(12) United States Patent
Uneme

(10) Patent No.: US 9,547,259 B2
(45) Date of Patent: Jan. 17, 2017

(54) DEVELOPMENT DEVICE

(71) Applicant: CANON KABUSHIKI KAISHA, Tokyo (JP)

(72) Inventor: Tetsushi Uneme, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/012,063

(22) Filed: Aug. 28, 2013

(65) Prior Publication Data

US 2014/0064778 A1 Mar. 6, 2014

(30) Foreign Application Priority Data

Aug. 31, 2012 (JP) ..... 2012-191479

(51) Int. Cl.
*G03G 15/08* (2006.01)
*G03G 21/18* (2006.01)

(52) U.S. Cl.
CPC ..... *G03G 15/0898* (2013.01); *G03G 15/0817* (2013.01); *G03G 21/1832* (2013.01); *G03G 2221/1648* (2013.01)

(58) Field of Classification Search
CPC ..... G03G 15/0817; G03G 15/0898; G03G 15/0894; G03G 21/1832; G03G 2221/1648
USPC ..... 399/98, 102, 103, 105, 106
See application file for complete search history.

(56) References Cited

U.S. PATENT DOCUMENTS

| | | | | |
|---|---|---|---|---|
| 6,505,020 | B1 * | 1/2003 | Higeta et al. | 399/109 |
| 7,068,961 | B2 * | 6/2006 | Shiraki et al. | 399/103 |
| 7,630,665 | B2 * | 12/2009 | Ueno et al. | 399/102 |
| 8,301,056 | B2 * | 10/2012 | Matsushita et al. | 399/103 |
| 8,478,158 | B2 * | 7/2013 | Matsushita et al. | 399/102 |
| 8,660,460 | B2 * | 2/2014 | Itabashi | 399/103 |
| 2010/0092206 | A1 * | 4/2010 | Matsushita et al. | 399/103 |

FOREIGN PATENT DOCUMENTS

| | | | |
|---|---|---|---|
| JP | 2000-105501 | A | 4/2000 |
| JP | 2005-106860 | A | 4/2005 |
| JP | 2006-227662 | A | 8/2006 |
| JP | 2006-251145 | A | 9/2006 |
| JP | 2009-265612 | A | 11/2009 |
| JP | 2010-66316 | A | 3/2010 |
| JP | 2012-003239 | A | 1/2012 |

* cited by examiner

*Primary Examiner* — David Gray
*Assistant Examiner* — Carla Therrien
(74) *Attorney, Agent, or Firm* — Canon U.S.A. Inc., IP Division

(57) ABSTRACT

A development device used for an image forming apparatus includes a frame member, a developer bearing member configured to develop a latent image formed on an image bearing member using developer, and an edge portion sealing member provided between an edge portion in a rotational axis direction of the developer bearing member and the frame member to prevent the developer from leaking to an outside of the development device from between the edge portion and the frame member, and including, in a state of being compressed between the edge portion and the frame member, a layer that includes an aggregate of a plurality of foam cells in which a foam cell communicating with an adjacent cell via a communication hole and a foam cell not communicating with an adjacent cell are mixed in a direction from an inside of the development device to the outside thereof.

13 Claims, 13 Drawing Sheets

DEVELOPMENT DEVICE

BACKGROUND OF THE INVENTION

Field of the Invention

The present invention relates to a development device detachably mounted to an image forming apparatus.

Description of the Related Art

An electrophotography image forming apparatus (hereinbelow referred to as an "image forming apparatus") such as a copy machine, a facsimile, and a printer using an electrophotography process uniformly charges a photosensitive drum to form a latent image (electrostatic latent image) by selective exposure onto the photosensitive drum. The latent image is developed with toner (developer), actualized (visualized) as a toner image, and then transferred onto a recording medium. Heat and pressure are applied to the transferred toner image to fix the toner image onto the recording medium. Thus, an image is recorded on a recording member.

Since such an image forming apparatus requires tonner supply or maintenance of various types of process units, an image forming apparatus adopting a process cartridge method is known, as a unit for facilitating a tonner supply operation or maintenance. All or part of the photosensitive drum, a charging unit, a development unit, and a cleaning unit are put together in a frame member to be contained in a cartridge, which is detachably mounted to the main body of the image forming apparatus. By the process cartridge method, a user can perform the maintenance of the apparatus by replacing a development device or a process cartridge, thereby significantly improving operability. Thus, the process cartridge method has been widely used for the image forming apparatus.

The process cartridge method includes various types according to configurations for integrally forming units as a cartridge. For example, there is provided a development cartridge in which a developing roller for developing an electrostatic latent image formed on a photosensitive drum, a development frame member for storing toner, and a developing blade are disposed. There is also provided the process cartridge in which the photosensitive drum is further added to the development cartridge.

To prevent leakage of toner from the development frame member for storing the toner, various types of sealing members are provided at various portions of a development device in the development cartridge and the process cartridge. First, as a first sealing member, a flexible sheet member is provided on the development frame member. The flexible sheet member abuts on the surface of the developing roller entirely in a longitudinal direction of the rotating developing roller (the axis direction of the developing roller) to prevent the toner from leaking from between the development frame member and the developing roller. Further, as a second sealing member, a bottom sealing member is provided entirely in the longitudinal direction of the developing roller. The bottom sealing member prevents the toner from leaking from between the developing blade and the development frame member. Furthermore, as a third sealing member, a development edge portion sealing member is provided near both ends of the developing roller in the longitudinal direction. The development edge portion sealing member prevents the toner from leaking from between the development frame member and the developing roller.

As a sealing unit for preventing the toner from leaking from a portion surrounded by the development edge portion sealing member, the development frame member, and the flexible sheet member, Japanese Patent Application Laid-Open No. 2000-105501 discusses the sealing unit having a sealing configuration in which an elastic sealing member is disposed to closely contact the above-described portions.

The longer operating life of the development device can generate continuous shock caused by increase in the number of repetitions of separation and abutment between the developing roller and the photosensitive drum for an image forming operation. The longer operating life of the development device can also generate a friction force acting for longer hours between the developing roller and the development edge portion sealing member caused by driving of the developing roller. In the above-described sealing configuration of the conventional example, this friction force acts in a direction in which the development edge portion sealing member and the elastic sealing member are separated from each other. If the operating life of the development device is extended, it may be difficult to maintain adhesion between the development edge portion sealing member and the elastic sealing member.

To solve the above-described problem, the development edge portion sealing member using material having better airflow is adopted, the elastic sealing member in a fluid state, which is melted at a high temperature when assembled, is infiltrated into the material having higher air permeability, to improve close contact between the development edge portion sealing member and the elastic sealing member.

However, the longer operating life of the development device can generate the continuous shock caused by the increase in the number of repetitions of separation and abutment between the developing roller and the photosensitive drum, and the toner may infiltrate into the development edge portion sealing member using the material having higher air permeability. This may cause toner leakage.

SUMMARY OF THE INVENTION

The present invention relates to a development device capable of reducing toner leakage for a long period to make an operating life thereof longer.

According to an aspect of the present invention, a development device used for an image forming apparatus includes a frame member, a developer bearing member configured to develop a latent image formed on an image bearing member using developer, and an edge portion sealing member provided between an edge portion in a rotational axis direction of the developer bearing member and the frame member to prevent the developer from leaking to an outside of the development device from between the edge portion and the frame member, and including, in a state of being compressed between the edge portion and the frame member, a layer that includes an aggregate of a plurality of foam cells in which a foam cell communicating with an adjacent cell via a communication hole and a foam cell not communicating with an adjacent cell are mixed in a direction from an inside of the development device to the outside thereof.

According to another aspect of the present invention, a development device used for an image forming apparatus includes a frame member, a developer bearing member configured to develop a latent image formed on an image bearing member using developer, and an edge portion sealing member provided between an edge portion in a rotational axis direction of the developer bearing member and the frame member to prevent the developer from leaking to an outside of the development device from between the edge portion and the frame member, and including a layer including an aggregate of a plurality of foam cells, wherein, when a test piece in a ring shape, formed of a same material as the layer and having an inside diameter of 32 mm, an outside diameter of 36 mm, and a thickness of 1.5 mm, is sandwiched between facing surfaces in a thickness direction in such a manner as to seal a region surrounded by an inside diameter portion of the test piece, and air is let in the region at 1.0 kPa, permeability of an air amount escaping from the inside diameter portion of the test piece to an outside diameter portion thereof is 10 ml/min to 300 ml/min if the thickness of the test piece is 1.5 mm, and 0 ml/min to 200 ml/min if the test piece is pressed to the thickness of 1.0 mm on the facing surfaces.

Further features of the present invention will become apparent from the following description of exemplary embodiments with reference to the attached drawings.

DESCRIPTION OF THE EMBODIMENTS

Figure 1A:
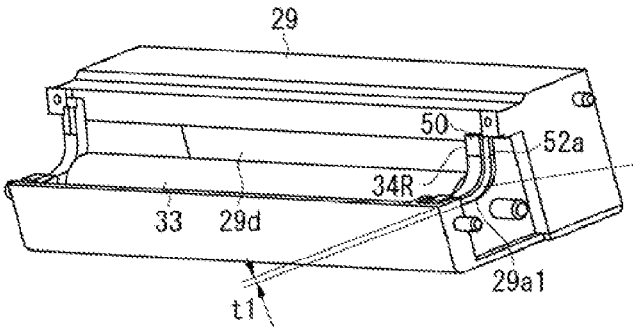
FIGS. 1A, 1B, 1C, and 1D illustrate an intermediate layer of a development edge portion sealing member in detail.

Various exemplary embodiments, features, and aspects of the invention will be described in detail below with reference to the drawings.

Dimensions, material, forms, and relative arrangement thereof described in the present exemplary embodiment are appropriately changed depending on the configuration of the apparatus to which the invention is applied, and various types of conditions. In other words, they are not intended to limit a scope of the invention to the exemplary embodiment described below.

According to the present exemplary embodiment, an image forming apparatus refers to an apparatus that forms an image on a recording medium using an electrophotography method. An example of the image forming apparatus includes an electrophotography copy machine, an electrophotography printer (e.g., a laser-beam printer and a light-emitting diode (LED) printer), a facsimile apparatus, and a word processor. A development device includes, in an integrated manner, a development unit used for developing an electrostatic latent image on an electrophotography photosensitive member, and constitutes part of the process cartridge or is detachably mounted to the image forming apparatus as a development device alone. A development cartridge includes at least a developer bearing member (developing roller), and the cartridge is detachably mounted to the main body of the image forming apparatus. A process cartridge includes, in an integral manner, at least one of a charging unit, the development unit, and a cleaning unit as a process unit, and the electrophotography photosensitive member (photosensitive drum) that is an image bearing member, and is detachably mounted to the image forming apparatus.

The exemplary embodiment of the present invention will describe a full-color-image forming apparatus, to which four process cartridges each including the development device are detachably mounted, as the image forming apparatus. However, the number of the process cartridges mounted to the image forming apparatus is not limited thereto and will be appropriately set as necessary. For example, when the image forming apparatus forms a monochrome image, one process cartridge is mounted to the image forming apparatus.

Further, according to the present exemplary embodiment described below, as an embodiment of the image forming apparatus, a printer will be described, but the embodiment of the image forming apparatus is not limited thereto. For example, the embodiment of the image forming apparatus can also be applied to other image forming apparatuses such as the copy machine and the facsimile apparatus, and other image forming apparatuses such as a multifunction peripheral apparatus combining those functions.

In the present exemplary embodiment, the process cartridge including the development device will be described. However, to implement the present invention, other configuration may be used. For example, the development device may be detachably mounted to the image forming apparatus, or the development device may be mounted into the image forming apparatus and may not be detachable.

<Outline of Configuration of Image Forming Apparatus>

Figure 2:
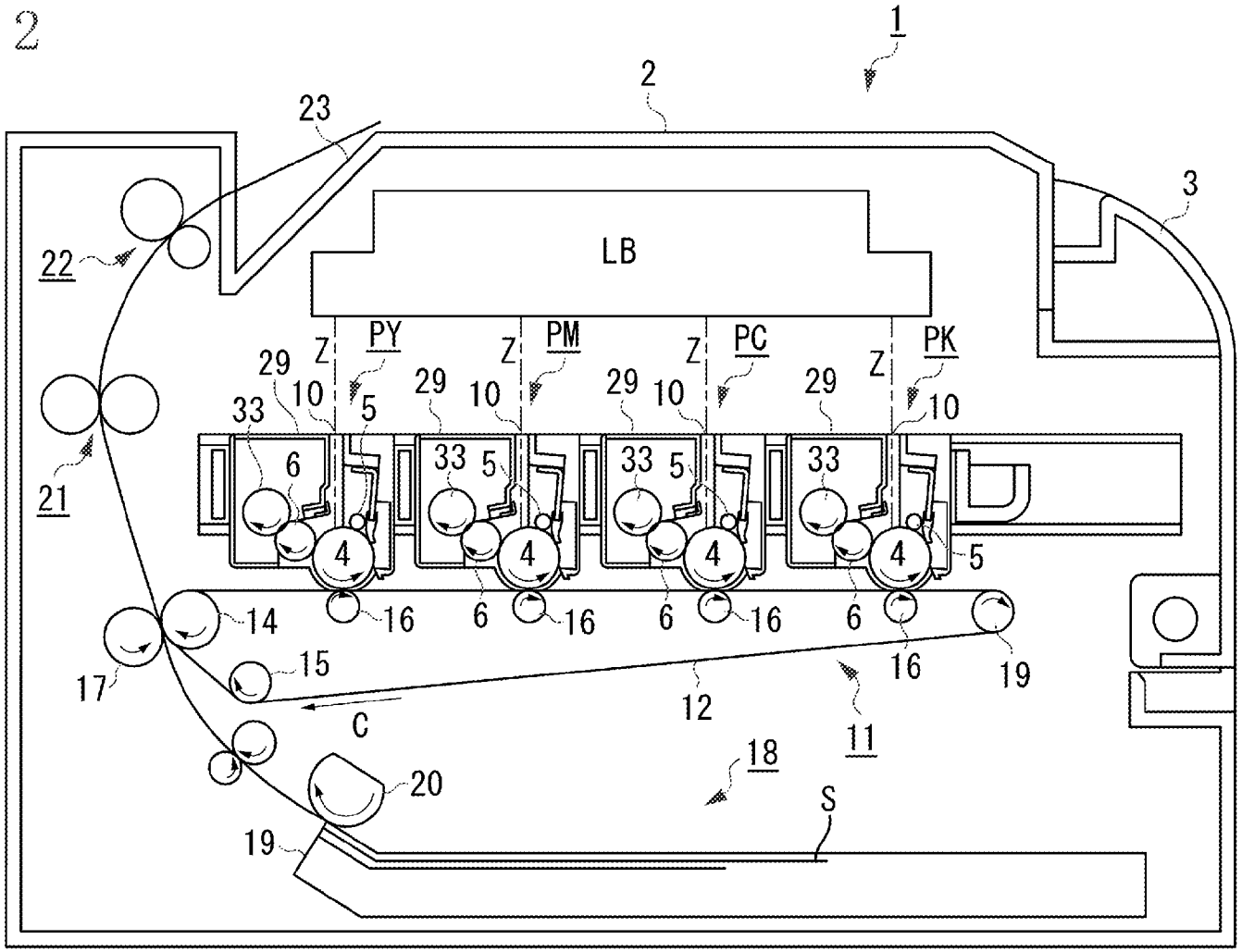
FIG. 2 is a schematic cross-sectional view illustrating an example of an electrophotography image forming apparatus.

FIG. 2 is a schematic cross-sectional view of the image forming apparatus according to the present exemplary embodiment. An image forming apparatus 1 is a full-color laser printer with four colors using the electrophotography process and forms a color image on a recording medium S. The image forming apparatus 1 adopts a process cartridge method, and the process cartridge (hereinbelow, referred to as a "cartridge") is detachably mounted to an apparatus main body 2 to form a color image on the recording medium.

As for the image forming apparatus 1, a side where an apparatus opening/closing door 3 is provided is defined as a front side (fore side) and a side opposite to the front side is defined as a back side (rear side). Further, a right side viewed from the front side of the image forming apparatus 1 is referred to as a driving side, and a left side is referred to as a non-driving side.

In the apparatus main body 2, four cartridges P, which are a first cartridge PY, a second cartridge PM, a third cartridge PC, and a fourth cartridge PK, are disposed in a horizontal direction. Each of the first to fourth cartridges P (PY, PM, PC, and PK) includes the similar type of electrophotography process mechanism and the different colors of toner. A rotation driving force is transmitted from a driving output unit (not illustrated) of the apparatus main body 2 to the first to fourth cartridges P (PY, PM, PC, and PK). Further, a bias voltage (charging bias, developing bias, and the like) (not illustrated) is supplied from the apparatus main body 2 to each of the first to fourth cartridges P (PY, PM, PC, and PK).

Figure 3:
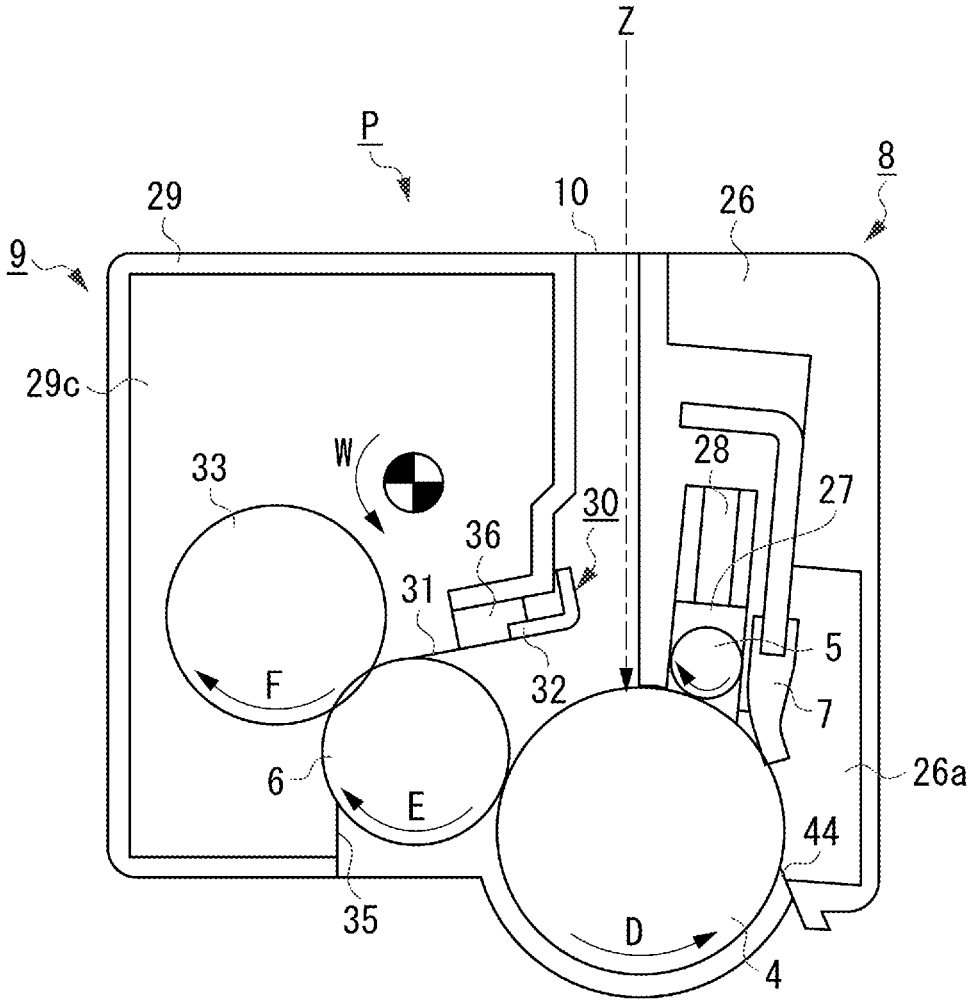
FIG. 3 is a cross-sectional view illustrating an example of a process cartridge.

FIG. 3 is a pattern cross-sectional view illustrating an example of the process cartridge according to the present exemplary embodiment. As illustrated in FIG. 3, each of the first to fourth cartridges P (PY, PM, PC, and PK) according to the present exemplary embodiment includes an electrophotography photosensitive member (photosensitive drum) 4 and a cleaning unit 8 including the charging unit and the cleaning member as the process unit operating for a photosensitive drum 4. Each of the first to fourth cartridges P (PY, PM, PC, and PK) includes a development device 9 including the development unit for developing the electrostatic latent image on the photosensitive drum 4. The cleaning unit 8 and the development device 9 are connected with each other. A charging roller 5 as the charging unit, a cleaning blade 7 as the cleaning member, and a developing roller 6 as the development unit are used. More specific configuration of the cartridge will be described below.

As illustrated in FIG. 2, the first cartridge PY stores yellow (Y) toner in a development frame member 29, and forms a yellow toner image on the surface of the photosensitive drum 4. A second cartridge PM stores magenta (M) toner in the development frame member 29, and forms a magenta toner image on the surface of the photosensitive drum 4. A third cartridge PC stores cyan (C) toner in the development frame member 29, and forms a cyan toner image on the surface of the photosensitive drum 4. A fourth cartridge PK stores black (K) toner in the development frame member 29, and forms a black toner image on the surface of the photosensitive drum 4.

Above the first to fourth cartridges P (PY, PM, PC, and PK), a laser scanner unit LB as an exposing unit is disposed. The laser scanner unit LB outputs a laser beam Z corresponding to image information. The laser beam Z passes through an exposure window portion 10 of the cartridge P to scan and expose the surface of the photosensitive drum 4.

Below the first to fourth cartridges P (PY, PM, PC, and PK), an intermediate transfer belt unit 11 as a transfer member is disposed. The intermediate transfer belt unit 11 includes a driving roller 13, a turn roller 14, and a tension roller 15 and a flexible transfer belt 12 is hung. The bottom face of the photosensitive drum 4 of the first to fourth cartridges P (PY, PM, PC, and PK) is in contact with the top face of the transfer belt 12. A contact portion therebetween is a primary transfer portion. Inside the transfer belt 12, a primary transfer roller 16 is disposed opposite to the photosensitive drum 4. A secondary transfer roller 17 abuts on the turn roller 14 via the transfer belt 12. The contact portion between the transfer belt 12 and the secondary transfer roller 17 is a secondary transfer portion.

Below the intermediate transfer belt unit 11, a paper feeding unit 18 is disposed. The paper feeding unit 18 includes a paper feeding tray 19 for loading and storing the recording medium S, and a paper feeding roller 20. At upper left in the apparatus main body 2 illustrated in FIG. 2, a fixing unit 21 and a discharge unit 22 are disposed. On the top face of the apparatus main body 2, a discharge tray 23 is provided. The toner image is fixed onto the recording medium S by a fixing member included in the fixing unit 21, and then discharged to the discharge tray 23.

<Image Forming Operation>

An operation for forming a full-color image will be described below.

The photosensitive drum 4 for each of the first to fourth cartridges P (PY, PM, PC, and PK) is rotated and driven (in the counterclockwise direction in FIG. 2 or in the arrow D direction in FIG. 3) at a predetermined speed. As illustrated in FIG. 2, the transfer belt 12 is also rotated and driven at a speed corresponding to the speed of the photosensitive drum 4 in a forward direction (in the arrow C direction) of the rotation thereof.

Subsequently, the laser scanner unit LB is driven. In synchronization with the driving of the laser scanner unit LB, in each cartridge, the charging roller 5 uniformly charges the surface of the photosensitive drum 4 with a predetermined polarity and potential. The laser scanner unit LB scans and exposes the surface of each photosensitive drum 4 with the laser beam Z according to an image signal of each color. Thus, the electrostatic latent image according to the image signal of corresponding color is formed on the surface of each photosensitive drum 4. The formed electrostatic latent image is developed by the developing roller 6 that is rotated and driven (in the clockwise direction in FIG. 2 or the arrow E direction in FIG. 3) at the predetermined speed.

By the electrophotography image forming process operation described above, on the photosensitive drum 4 of the first cartridge PY, a yellow toner image corresponding to yellow component of the full-color image is formed. The toner image is primarily transferred onto the transfer belt 12. In a similar manner, on the photosensitive drum 4 of the second cartridge PM, a magenta toner image corresponding to magenta component of the full-color image is formed. Subsequently the toner image is overlapped onto the yellow toner image that has been already transferred onto the transfer belt 12, to perform primary transfer thereon. In a similar manner, on the photosensitive drum 4 of the third cartridge PC, a cyan toner image corresponding to cyan component of the full-color image is formed. Subsequently, the toner image is overlapped onto the yellow and magenta toner images that have been already transferred onto the transfer belt 12 to perform primary transfer thereon. In a similar manner, on the photosensitive drum 4 of the fourth cartridge PK, a black toner image corresponding to black component of the full-color image is formed. Subsequently, the toner image is overlapped onto the yellow, magenta, and cyan toner images that have been already transferred onto the transfer belt 12, to perform primary transfer thereon.

As described above, an unfixed toner image in the four full colors of yellow, magenta, cyan, and black is formed on the transfer belt 12.

The recording medium S is separated one by one and fed at a predetermined control timing. The recording medium S is guided into a secondary transfer portion, which is an abutment portion between the secondary transfer roller 17 and the transfer belt 12 at a predetermined control timing. Thus, in a process of conveying the recording medium S to the secondary transfer portion, the four-color overlapped toner images on the transfer belt 12 are correctively transferred sequentially onto the recording medium S.

<Configuration of Cartridge>

Figure 4:
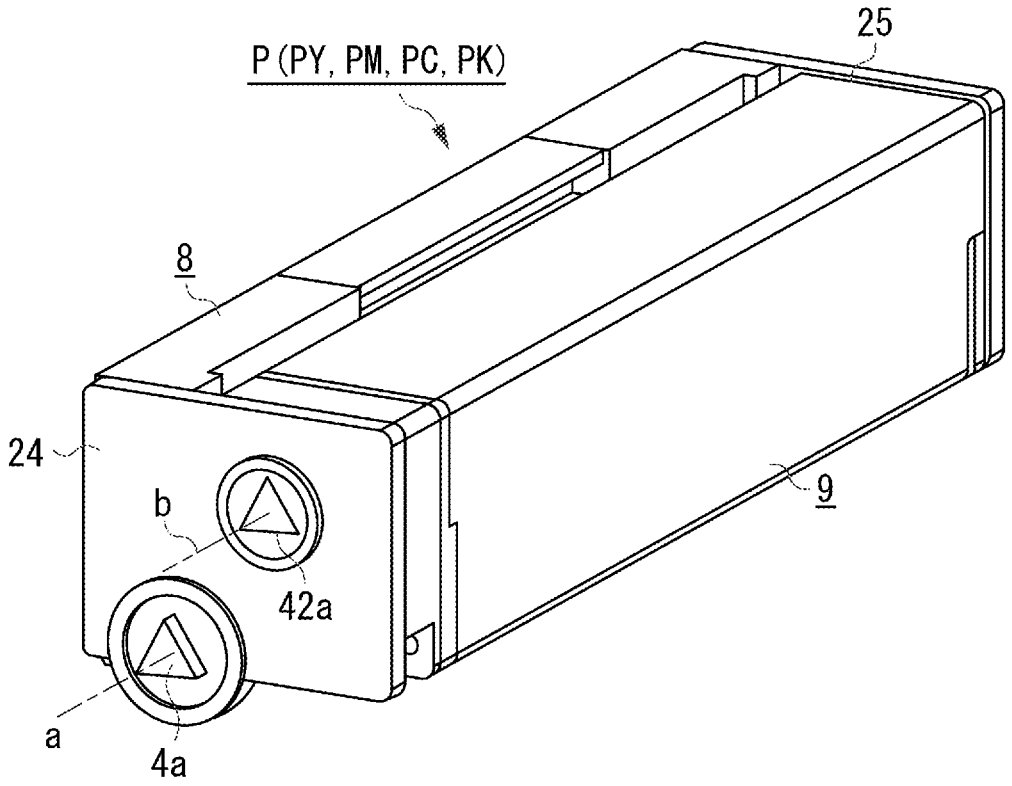
FIG. 4 is a perspective view illustrating an example of the process cartridge.

FIG. 4 is a perspective view illustrating an example of the process cartridge according to the present exemplary embodiment. As illustrated in FIG. 4, the cartridges P (PY, PM, PC, and PK) each include the cleaning unit 8, the development device 9, a driving side cover member 24, and a non-driving side cover member 25. As illustrated in FIG. 3, the cleaning unit 8 includes a cleaning container 26 including the photosensitive drum 4, the charging roller 5, and the cleaning blade 7.

As illustrated in FIG. 4, the photosensitive drum is rotatably supported by the driving side covering member 24 and a non-driving side covering member 25, and acquires a driving force of a motor (not illustrated) of the apparatus main body 2 from a drum driving coupling 4*a* to be rotated and driven (in the arrow D direction in FIG. 3) As illustrated in FIG. 3, the charging roller 5 is rotatably supported by a charging roller bearing 27 of a cleaning container 26 at both edge portions thereof and is driven-rotated in contact with the surface of the photosensitive drum 4. Then, the charging roller 5 charges the surface of the photosensitive drum 4 upon reception of the supply of the charge bias. At this point, to uniformly charge the surface, the both edge potions of the charging roller 5 is pressed onto the surface of the photosensitive drum 4 by a pressure spring 28.

The cleaning blade 7 is fixed to the cleaning container 26, and an elastic rubber portion at a leading edge portion of the cleaning blade 7 abuts on the photosensitive drum 4 in a counter direction of a rotation direction (the arrow D direction in FIG. 3) of the photosensitive drum 4. When the image is formed, remaining transfer toner that remains on the photosensitive drum 4 is gathered up to clean the surface of the photosensitive drum 4. At this point, the leading edge of the cleaning blade 7 abuts on the surface of the photosensitive drum 4 with a predetermined pressure to completely scratch off the remaining transfer toner.

Further, the remaining transfer toner gathered up from the surface of the photosensitive drum 4 by the cleaning blade 7 is stored in a wasted toner storage portion 26*a* of the cleaning container 26 as wasted toner. Thus, a wasted toner collecting seat member 44 is fixed in the cleaning container 26 in the longitudinal direction of the photosensitive drum 4, to prevent the wasted toner from leaking from the photosensitive drum 4 or from a gap between the photosensitive drum 4 and the cleaning blade 7. Further, the cleaning blade edge portion sealing member (not illustrated) is disposed at the both edge portions in the longitudinal direction of the cleaning blade 7.

<Configuration of Detachably Mounted Cartridge>

Figure 5:
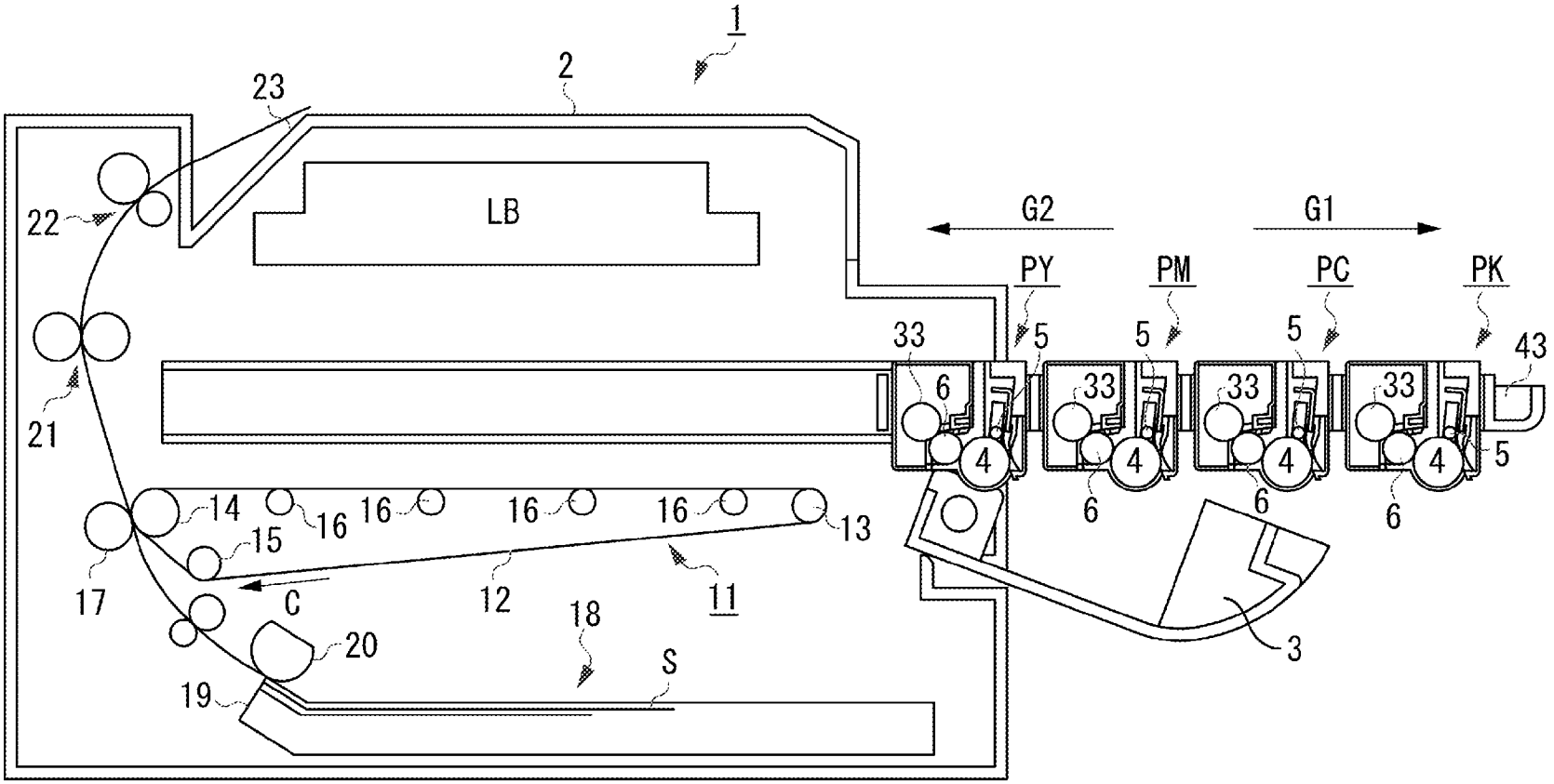
FIG. 5 is a schematic cross-sectional view illustrating a state in which the process cartridge is detachably mounted.
Figure 6:
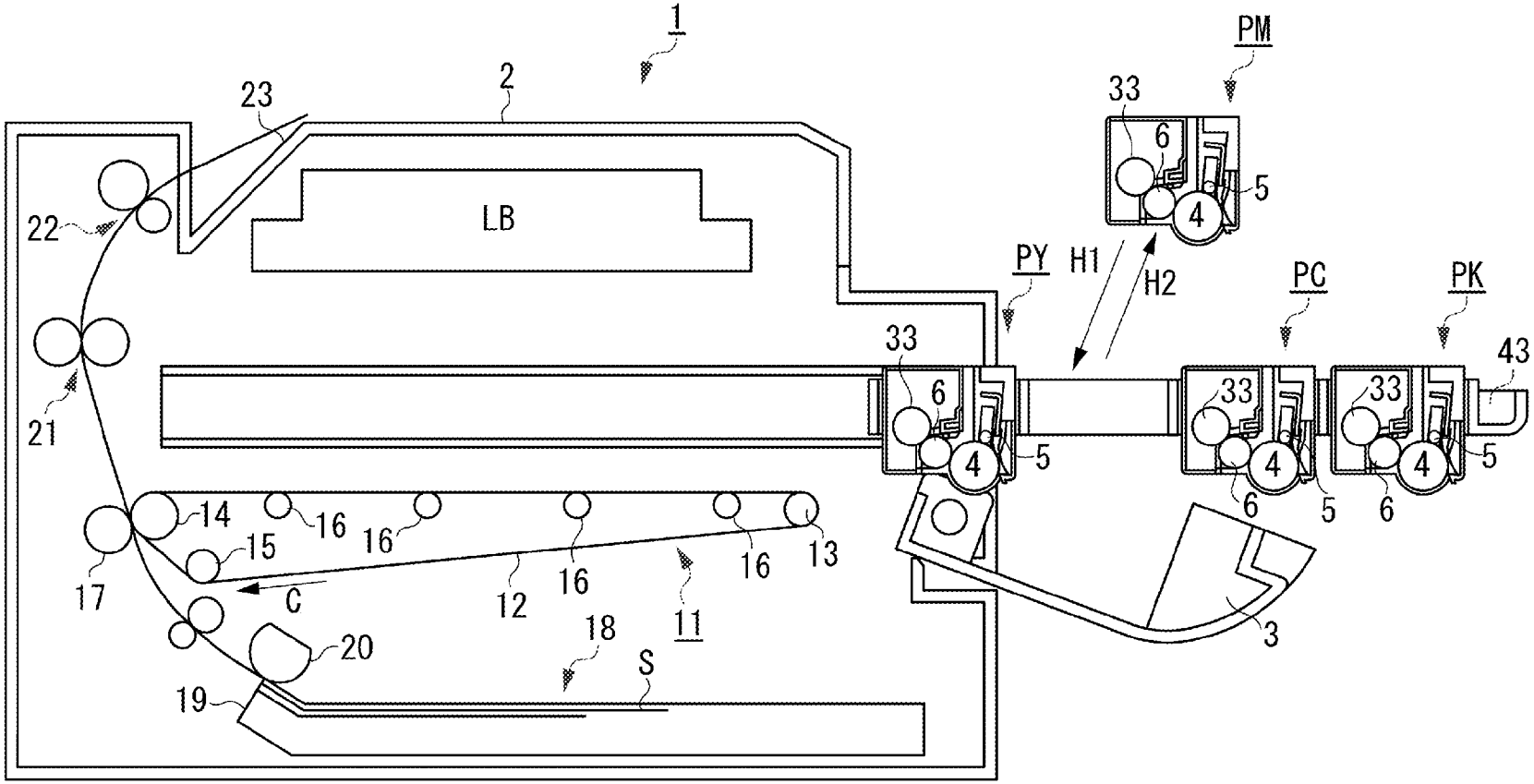
FIG. 6 is a schematic cross-sectional view illustrating a mounting/detaching operation of the process cartridge.

With reference to FIGS. 5 and 6, an operation for mounting/detaching the cartridges P (PY, PM, PC, and PK) to/from the apparatus main body 2 will be described. FIG. 5 is a schematic cross-sectional view illustrating a state in which a photosensitive cartridge 43 is drawn from the apparatus main body 2 so that the cartridges P (PY, PM, PC, and PK) can be mounted/detached. FIG. 6 is a schematic cross-sectional view illustrating an operation of mounting/detaching the cartridges P (PY, PM, PC, and PK) to/from the photosensitive cartridge 43.

In the apparatus main body 2, the photosensitive cartridge 43 to which the cartridges P (PY, PM, PC, and PK) can be mounted is disposed. As illustrated in FIG. 5, the photosensitive cartridge 43 can be moved linearly (drawn/pushed) in G1 and G2 directions, which are a substantially horizontal direction with respect to the apparatus main body 2. Further, the photosensitive cartridge 43 can be positioned at a mounting position in the apparatus main body 2 and at a drawn position where the photosensitive cartridge 43 is drawn from the mounting position.

First, the operation of mounting the cartridges P (PY, PM, PC, and PK) to the apparatus main body 2 will be described. As illustrated in FIG. 5, the apparatus opening/closing door 3 is opened and the photosensitive cartridge 43 is moved in the arrow G1 direction to move the photosensitive cartridge 43 to the drawn position. In this state, as illustrated in FIG. 6, the cartridge P is mounted to the photosensitive cartridge 43 in an arrow H1 direction and retained. The photosensitive cartridge 43 retaining the cartridges P (PY, PM, PC, and PK) is moved in the arrow G2 direction illustrated in FIG. 5, and then the photosensitive cartridge 43 is moved to the mounting position in the apparatus main body 2. The apparatus opening/closing door 3 is closed to complete the mounting operation of the cartridges P (PY, PM, PC, and PK) to the apparatus main body 2 as illustrated in FIG. 2.

Meanwhile, detaching the cartridges P (PY, PM, PC, and PK) from the apparatus main body 2 will be described. As illustrated in FIG. 5, in a similar manner to the mounting operation of the above-described cartridge P to the apparatus main body 2, the photosensitive cartridge 43 is moved to the drawn position. In this state, the cartridge P is drawn in an arrow H2 direction illustrated in FIG. 6, and then the detaching operation of the cartridge P from the apparatus main body 2 is completed.

With the operation described above, the cartridge P can be mounted/detached to/from the apparatus main body 2.

<Configuration of Development Device>

Figure 7A:
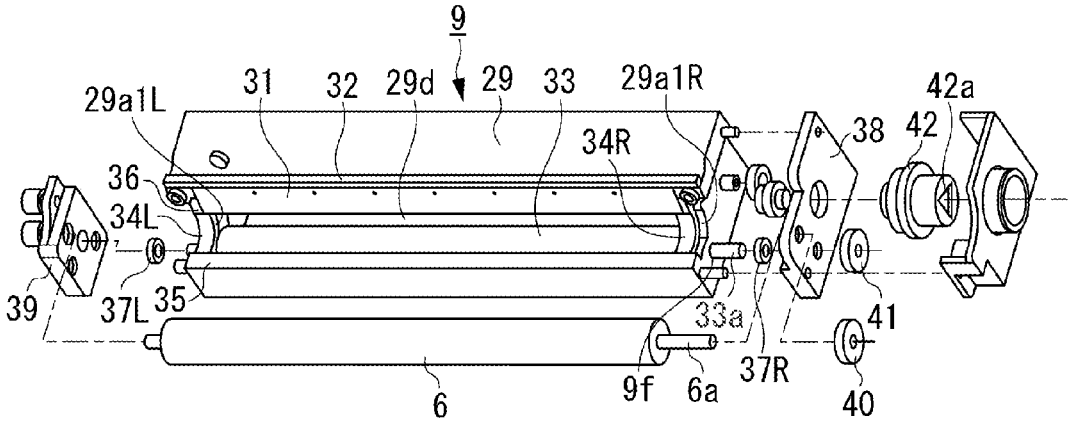
FIGS. 7A and 7B are exploded perspective view illustrating an example of a development device.
Figure 7B:
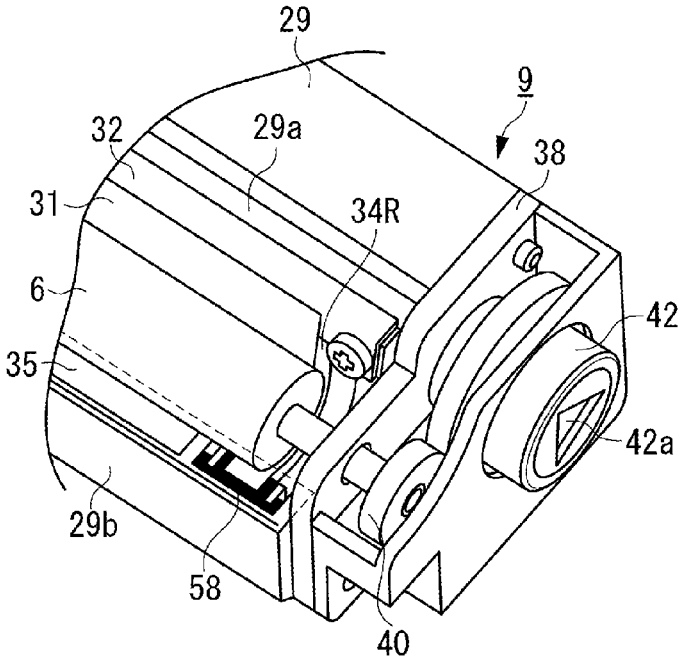
Figure 13A:
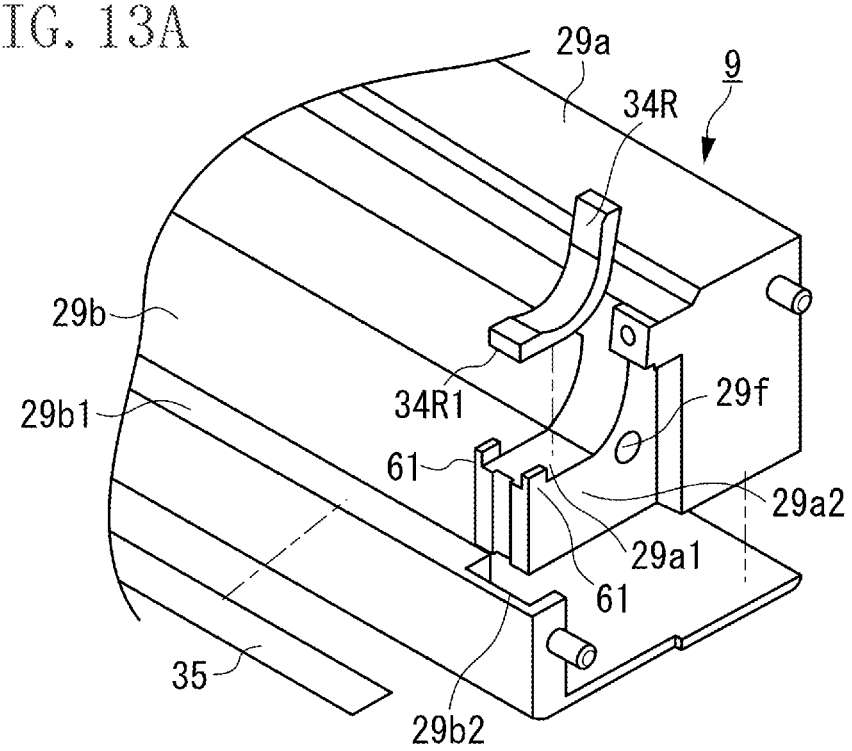
FIGS. 13A and 13B are schematic diagrams illustrating configurations of the development frame member.
Figure 13B:
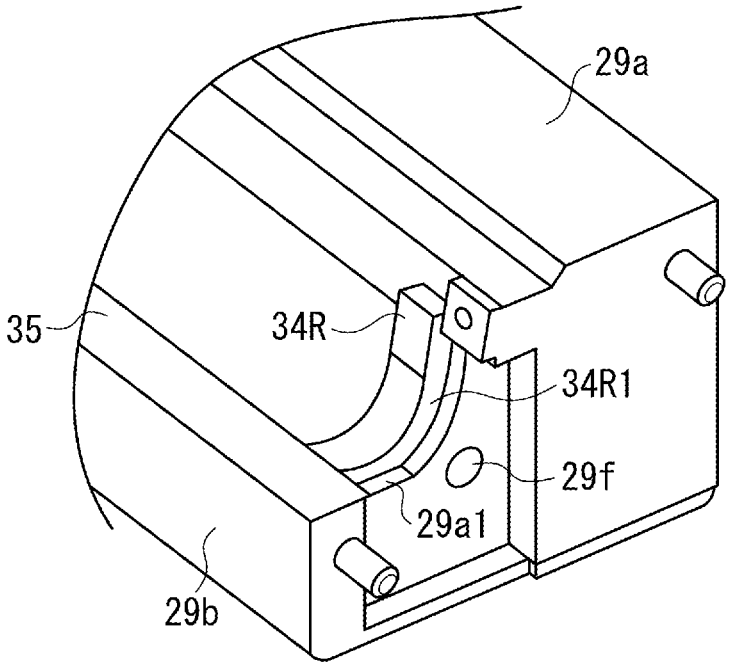

FIG. 7A is an exploded perspective view illustrating an example of the development device according to the present exemplary embodiment. FIG. 7B is an enlarged perspective view in the vicinity of a driving side edge portion seal 34*a* of the development device according to the present exemplary embodiment. FIG. 13A is an enlarged, exploded perspective view in the vicinity of the driving side edge portion seal 34*a* illustrating a configuration of the development frame member 29 according to the present exemplary embodiment. FIG. 13B is an enlarged perspective view illustrating a configuration of the development frame member 29 according to the present exemplary embodiment.

As illustrated in FIGS. 4 and 7A, the development device 9 has a horizontally long shape extended in the longitudinal direction of the rotation axis direction of the developing roller 6 as the development unit. In addition to the developing roller 6, a development frame member 29, a developing blade 31, a developer supplying roller 33, development edge portion sealing members 34R and 34L, a flexible sheet member 35, and developer supply roller axis sealing members 37R and 37L are included.

As illustrated in FIG. 13A, the development frame member 29 includes a first frame member 29*a* to which the developing blade 31, the developer supplying roller 33, and the development edge portion sealing members 34R and 34L are to be provided, and a second frame member 29*b* to which the flexible sheet member 35 is to be provided. The first frame member 29*a* and the second frame member 29*b* are joined in an integrated manner by ultrasonic wave welding and the like. The first frame member 29*a* and the second frame member 29*b* are welded to form a toner storage chamber 29*c* for storing the toner and an opening portion 29*d* for discharging the toner from a toner storage chamber 29*c*.

The developing roller 6 is arranged to include entire region of the opening portion 29*d* in the longitudinal direction to carry the toner discharged from the toner storage chamber 29*c*. Further, the developer supplying roller 33 is arranged to intrude into the developing roller 6 in a radial direction. The both edge portions of a core material 6*a* of the developing roller 6 and a core material 33*a* of the developer supplying roller 33 are rotatably supported by the driving side bearing 38 and the non-driving side bearing 39 provided at the both side surfaces of the development frame member 29.

The driving side edge portions for the core material 6*a* of the developing roller 6 and the core material 33*a* of the developer supplying roller 33 are disposed with a developing roller gear 40 and a supply roller gear 41, respectively, and are engaged with the development driving input gear 42. The development driving input gear 42 includes a development driving coupling 42*a*, engages with the driving output coupling (not illustrated) at a side of the apparatus main body 2 to transmit the driving force of the driving motor (not illustrated) of the apparatus main body 2, so that the developing roller 6 and the developer supplying roller 33 are rotated and driven at a predetermined speed.

The developing blade 31 is an elastic metal plate having a thickness of approximately 0.1 mm. A free end in a width direction of the developing blade 31 abuts on the developing roller 6 in the counter direction of the rotation direction (the arrow E direction in FIG. 3) of the developing roller 6 to regulate the thickness of a layer of the toner on the developing roller 6. As illustrated in FIG. 3, a development plate bottom sealing member (developer layer thickness regulation member bottom sealing member) 36 is disposed to infill a gap between the development frame member 29 and the developing blade unit entirely in the longitudinal direction to prevent the toner leakage.

Further, as illustrated in FIG. 7A, the development edge portion sealing members 34R and 34L are disposed at both ends of the opening portion 29*d* of the development frame member 29 to prevent the toner from leaking from the gap between the developing blade 31/the developing roller 6 and the development frame member 29. A detailed configuration of the development edge portion sealing members 34R and 34L will be described with reference to FIG. 8.

The flexible sheet member 35 is made of a plastic film, for example, polyethylene terephthalate and polyphenylene sulfide, and the thickness thereof is approximately 50 μm. The flexible sheet member 35 is disposed in such a manner to abut on the developing roller 6 along the longitudinal direction at a side opposite to the developing blade 31 at the opening portion 29*d* of the development frame member 29, to prevent the toner from leaking from the gap between the development frame member 29 and the developing roller 6.

As illustrated in FIG. 7B, to infill the gap between the first frame member 29*a*/the second frame member 29*b* and the development edge portion sealing member 34R/the flexible sheet member 35, an elastic sealing member 58 is filled to prevent the toner from leaking. In a similar manner, the gap between the first frame member 29*a*/the second frame member 29 band the development edge portion sealing member 34L/the flexible sheet member 35, the elastic sealing member 58 is filled to prevent the toner from leaking. The elastic sealing member 58 is formed of an elastic member including thermal plastic resin such as polystyrene, and desirably has viscosity of 110 mPa·s to 300 mPa·s or more when welded. More specifically, the elastic sealing member 58 is formed by filling resin material into a recessed portion formed of the first frame member 29*a*, the second frame member 29*b*, and the development edge portion sealing member 34.

The developer supply roller axis sealing members 37R and 37L are mounted to a portion of the core material 33*a* of the developer supplying roller 33 exposed outside of the development frame member 29, to prevent the toner from leaking from the gap between the core through hole 29*f* and the core material 33*a* disposed on the development frame member 29.

The development device 9 is always biased by a pressure spring (not illustrated) in a direction (the arrow W direction in FIG. 3) in which the developing roller 6 comes into contact with the photosensitive drum 4 around a sliding center (axis line "b") illustrated in FIG. 4. When the image is formed, the developing roller 6 abuts on the photosensitive drum 4, and when the image is not formed, the developing roller 6 is separated from the photosensitive drum 4 against the bias force of the pressure spring, which is described above, by a separation unit (not illustrated). According to the image formation or the no image formation, the development device repeatedly performs the separating/abutting operation.

When the image is formed, the developer supplying roller 33 and the developing roller 6 are driven to be rotated and frictionally slid, so that the toner in the development frame member 29 is carried on the developing roller 6. The developing blade 31 regulates the thickness of the toner layer to be formed on a peripheral face of the developing roller 6, and applies charge, which is generated by friction charge with the developing roller 6 by an abutting pressure, to the toner. Thus, the toner charged on the developing roller 6 is attached to the electrostatic latent image on the photosensitive drum 4 at a contact portion between the developing roller 6 and the photosensitive drum 4, and then the latent image is developed.

<Configuration of Development Blade Bottom Sealing Member>

The developing blade bottom sealing member 36 is disposed in such a manner to closely contact the developing blade 31 and a supporting plate 32 of the developing blade unit 30, and further the development edge portion sealing members 34L and 34R, to seal the toner from the development opening 29*d*. The developing blade bottom sealing member 36 according to the present exemplary embodiment is molded by the thermal plastic resin. With a mold abutting on the development frame member 29, the resin is filled to mold the developing blade bottom sealing member 36.

<Configuration of Development Edge Portion Sealing Member>

Figure 8:
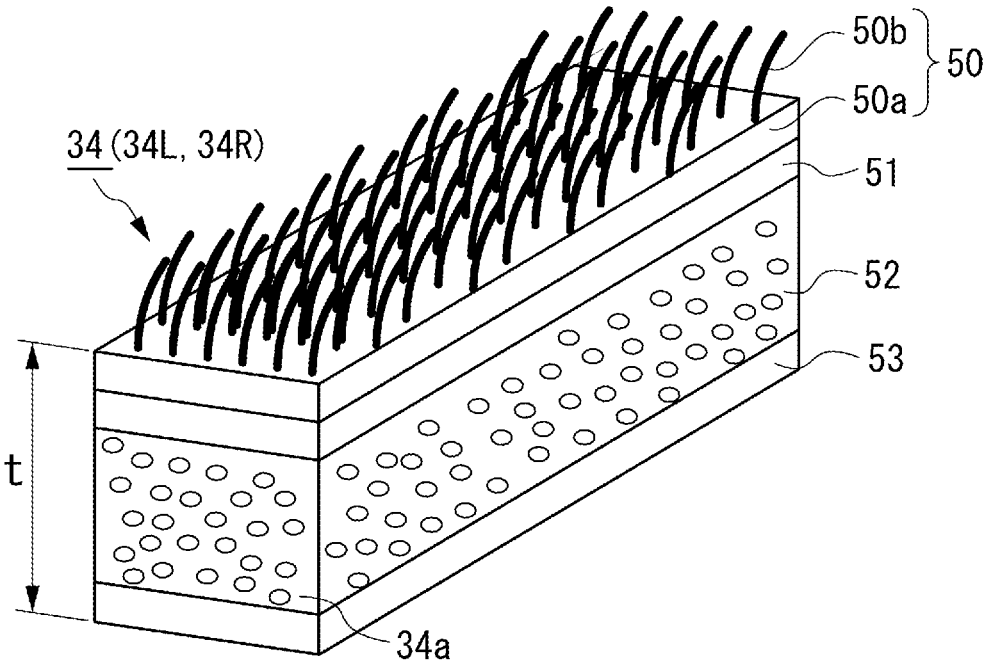
FIG. 8 is a detailed configuration diagram illustrating an example of the development edge portion sealing member.

FIG. 8 is a detailed configuration diagram illustrating an example of the development edge portion sealing members 34R and 34L according to the present exemplary embodiment. Since the development edge portion sealing members 34R and 34L have a similar configuration, the description thereof will be made as the development edge portion sealing member 34 below.

As illustrated in FIG. 8, the development edge portion sealing member 34 includes a surface layer 50, an adhesion layer 51, an intermediate layer 52, and attachment layer 53. As illustrated in FIGS. 1A, 1C, 7A, and 7B, the development edge portion sealing member 34 is disposed between a development edge portion sealing member attaching seating face 29*a*1 (29*a*1R and 29*a*1L) and the developing roller 6 as a support portion of the development frame member 29 and has a toner sealing function for preventing the toner from leaking.

The surface layer 50 includes a basic cloth 50*a* and pile yarn 50*b* raised therefrom, short hair adhering to the basic cloth by electrostatic hair implanting, or includes only the basic cloth 50*a*. The surface layer 50 is joined onto the surface of the intermediate layer 52 via the adhesion layer 51 such as double-stick tape and adhesion. Material of pile yarn 50*b* includes a synthetic material such as polyethylene, polypropylene, polyester, nylon, acrylic resin, and polyethylene terephthalate, semi-synthetic fiber cotton such as rayon, and natural fabric such as cotton. Or, the material obtained by combining the above-described materials, or the materials on which twisted yarn processing is performed may be used.

The intermediate layer 52 is a cushion layer formed of an elastic member. The material of the intermediate layer 52 is formed of foam of synthetic resin such as polyurethane. The elastic sealing member 58 of the thermal plastic resin and the developing blade bottom sealing member 36 described above are formed in such a manner to closely contact the intermediate layer 52 of the development edge portion sealing member 34. At this point, the thermal plastic resin is filled to be formed in a melted state at a high temperature so that part of resin is infiltrated into the foam of the intermediate layer 52. With this method, the development edge portion sealing member 34, the elastic sealing member 58 of the thermal plastic resin, and the developing blade bottom sealing member 36 can closely come in contact with one another without any gaps. Details will be described below.

The attachment layer 53 is formed of the double-stick tape or pressure-sensitive adhesive. Other material may be used for the attachment layer 53 as long as the material has flexibility and retains sufficient adhesion strength with respect to the intermediate layer 52.

Other shapes may be adopted for the development edge portion sealing member 34. For example, a notch may be provided at part of the development edge portion sealing member 34 according to the shape of the development edge portion sealing member attaching seating face 29*a*1 (illustrated in FIGS. 1A and 1C) and the peripheral configuration thereof.

<Configuration of Toner Sealing by Development Edge Portion Sealing Member>

Figure 1B:
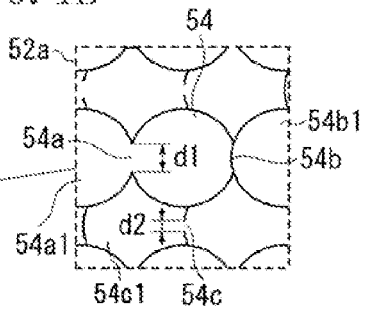
Figure 1C:
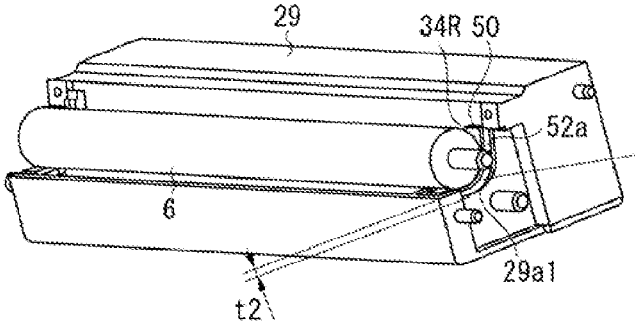
Figure 1D:
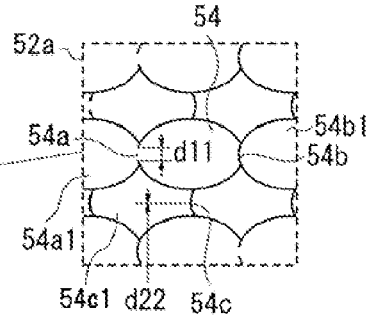

With reference to FIGS. 1A to 1D, and FIGS. 8 to 11, the toner sealing configuration by the development edge portion sealing member 34 will be described. FIGS. 1A to 1D illustrate the intermediate layer of the development edge portion sealing member according to the present exemplary embodiment. FIG. 1A illustrates the development frame member 29 in a state where the development edge portion sealing member 34 is attached to the development edge portion sealing member seating face 29*a*1. FIG. 1B is a schematic view of the foam cell 54 of the intermediate layer 52 in the development edge portion sealing member 34 illustrated in FIG. 1A. FIG. 1C illustrates the development frame member 29 in a state where the developing roller 6 is disposed in the configuration illustrated in FIG. 1A. FIG. 1D is a schematic view of the foam cell 54 in the intermediate layer 52 of the development edge portion sealing member 34 illustrated in FIG. 1C. FIGS. 9A and 9B illustrate configurations of the intermediate layer configured by the foam cell. FIG. 9A illustrates a comparison example, and FIG. 9B illustrates the present exemplary embodiment. FIGS. 10A to 10C are schematic views illustrating the development device and the development edge portion sealing member according to the present exemplary embodiment. FIG. 10A is a plan view in a state before the developing roller 6 is mounted. FIG. 10B is a cross-sectional view taken along the line F-F illustrated in FIG. 10A. FIG. 10C illustrates a state where the developing roller 6 is mounted into the configuration illustrated in FIG. 10B to be driven. FIGS. 11A and 11B are schematic cross-sectional views illustrating an X portion, which is a boundary portion of the intermediate layer 52 including the elastic sealing member 58 and the development edge portion sealing member 34 illustrated in FIG. 10B. FIG. 11A illustrates the present exemplary embodiment, and FIG. 11B illustrates a comparison example.

The development edge portion sealing member 34 adheres and is fixed onto the development edge portion sealing member seating face 29*a*1 in a state where the surface layer 50 is curved along an outer periphery of the developing roller 6. The developing roller 6 is mounted in such a manner to press the development edge portion sealing member 34, so that the development edge portion sealing member 34 has a certain abutting pressure against the developing roller 6 by a reaction force of the intermediate layer 52. With the abutting pressure, the pile yarn 50*b* configuring the surface layer 50 of the development edge portion sealing member 34 seals the toner by abutting on the surface of the developing roller 6.

Subsequently, a configuration will be described in which, with the shock caused by the above-described developing roller 6 separating/abutting from/on the photosensitive drum 4, the toner is unlikely to leak from the intermediate layer 52, which is the foam.

The developing roller 6 is disposed while the pile yarn 50*b* of the development edge portion sealing member 34 and the intermediate layer 52, which is a cushion layer, are being pressed in a thickness "t" direction illustrated in FIG. 8. In other words, as illustrated in FIGS. 1A and 1C, the thickness of the intermediate layer 52 varies from t1 to t2 , and t1 >t2 is satisfied.

As illustrated in FIG. 1B, the intermediate layer according to the present exemplary embodiment is configured as an aggregate of the foam cells of approximately two types before the intermediate layer 52 is compressed by mounting developing roller 6. In other words, the intermediate layer 52 includes the foam cell (e.g., foam cell 54*a*1) connected with a plurality of adjacent foam cells 54 via the communication hole 54*a*, and the foam cell (e.g., foam cell 54*b*1) independent with a foam film 54*b* without being communicating with the adjacent foam cells.

Of the foam cells connected with the adjacent foam cell via the communication hole as illustrated in FIG. 1B, the width of the communication hole 54*a* before the developing roller 6 is disposed is defined as d1, and the width of the communication hole 54*c* is defined as d2. Further, as illustrated in FIG. 1D, the width of the communication hole 54*a* after the developing roller 6 is disposed is defined as d11, and the width of the communication hole 54*c* is defined as d22. The width of the communication hole 54*a*, of the communication holes described above, is changed from d1 to d1 when the developing roller 6 is disposed, and d11>0 is satisfied. When the developing roller 6 is disposed, the width of the communication hole 54*c* is changed from d2 to d22, and d22=0 is satisfied. This indicates a state where the communication hole is pressed and thus is not communicating.

In other words, as illustrated in FIG. 1D, the intermediate layer 52 is configured as the aggregate of the foam cells of approximately three types after the intermediate layer 52 is compressed by mounting the developing roller 6. A first foam cell is an independent foam cell (e.g., foam cell 54*b*1) that is independent with the foam film. A second foam cell is an opening communication foam cell (e.g., foam cell 54*a*1) including an opening communication hole (e.g., communication hole 54*a*) that is not pressed after the developing roller 6 is mounted. A third foam cell is a closed foam cell (e.g., foam cell 54*c*1) including a closed communication hole (e.g., communication hole 54*c*) that is pressed by mounting the developing roller 6.

Figure 9A:
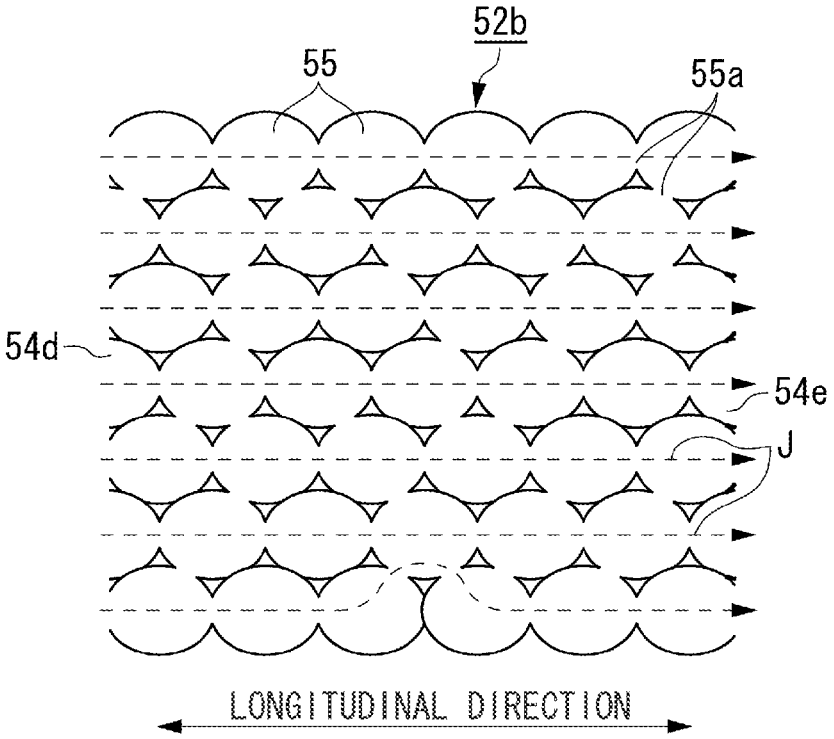
FIGS. 9A and 9B illustrate an example of a detailed configuration of an intermediate layer of the development edge portion sealing member.

FIG. 9A illustrates the intermediate layer 52*b* in detail after the developing roller is disposed for the development edge portion sealing member including the intermediate layer 52*b* of the aggregate of the opening form cells (e.g., foam cell 55) to which all the foam cells as the first comparison example are communicating with each other via the opening communication hole. According to the first comparison example, the foam cell 55 in the intermediate layer 52*b* of a face 54*d* inside in the longitudinal direction of the development edge portion sealing member 34 and the foam cell 55 in the intermediate layer 52*b* of the face 54*e* outside in the longitudinal direction thereof are linearly connected with each other in the longitudinal direction via the communication hole 55*a* (as indicated by a broken line J). In this state, due to the intermittent shocks caused by repeatedly performed separating/abutting operation from/on the developing roller 6 when the image is formed, the toner is infiltrated from the foam cell 55 at the face 54*d* side into the foam cell 55 at the 54*e* side, and thus it takes less time for the toner to reach outside the development frame member 29. Therefore, when the operating life of the development device is made longer, the toner may leak outside thereof.

Figure 9B:
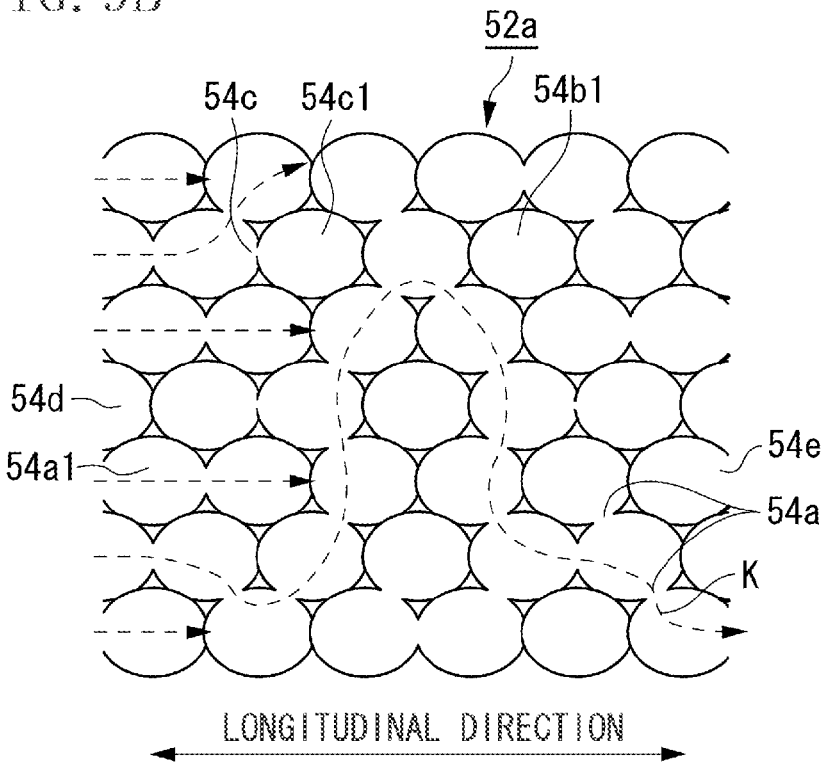

In contrast, FIGS. 1D and 9B illustrate the foam cells forming the intermediate layer 52*a* according to the present exemplary embodiment in a state where the developing roller 6 is disposed. In the intermediate layer 52*a* according to the present exemplary embodiment, the foam cell 54 in the intermediate layer 52*a* of the face 54*d* inside in the longitudinal direction of the development edge portion sealing member 34 and the foam cell 54 in the intermediate layer 52*a* of the face 54*e* outside in the longitudinal direction thereof are connected with each other via a curved connected pathway as indicated with a broken line K, and thus the pathway is longer than that of the above-described comparison example. Therefore, even with the intermittent shocks caused by the repeatedly performed separating/abutting operation from/on the developing roller 6 when the image is formed, it takes more time for the toner to reach outside the development frame member 29, and thus the toner will not leak even if the operating life of the development device is made longer.

Figure 10A:
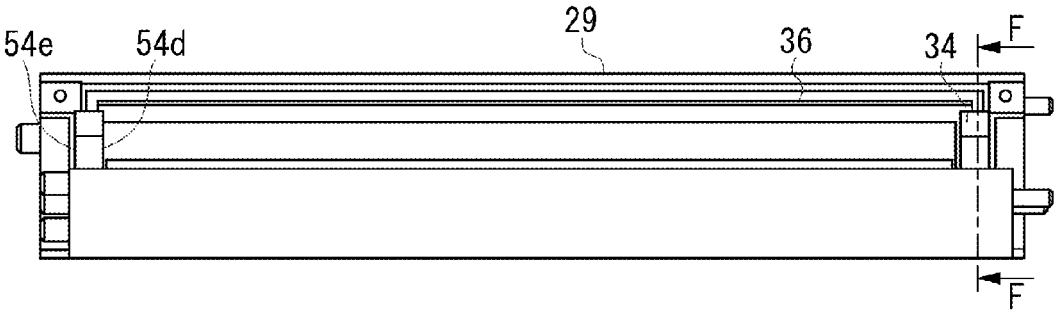
FIGS. 10A, 10B, and 10C are schematic views illustrating the development device and the development edge portion sealing member.
Figure 10B:
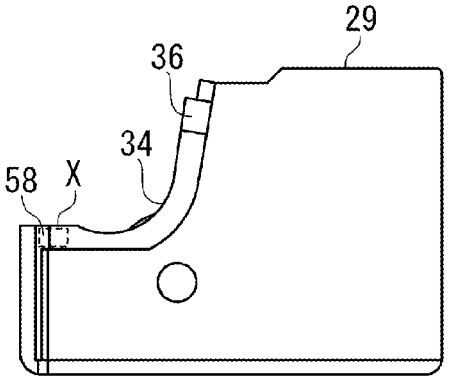
Figure 10C:
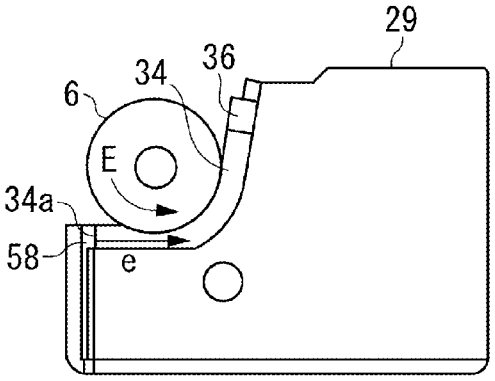

Subsequently, with regard to a boundary face between an edge face 34*a* at the developing roller rotation direction upper stream side of the development edge portion sealing member 34 and the elastic sealing member 58, a configuration of sealing the toner at the X portion indicated in FIG. 10B will be described. As described in FIG. 10C, a friction force is applied between the surface of the developing roller 6 and the surface layer 50 of the development edge portion sealing member 34 by rotation of the developing roller 6 in an E direction. With the friction force, at the boundary portion between the edge face 34*a* at the developing roller rotation direction upper stream side and the elastic sealing member 58, a force for peeling off the development edge portion sealing member 34 at a downstream side is applied in the arrow e direction, with respect to the elastic sealing member 58 at the upper stream side in the rotation direction of the developing roller 6.

Figure 11A:
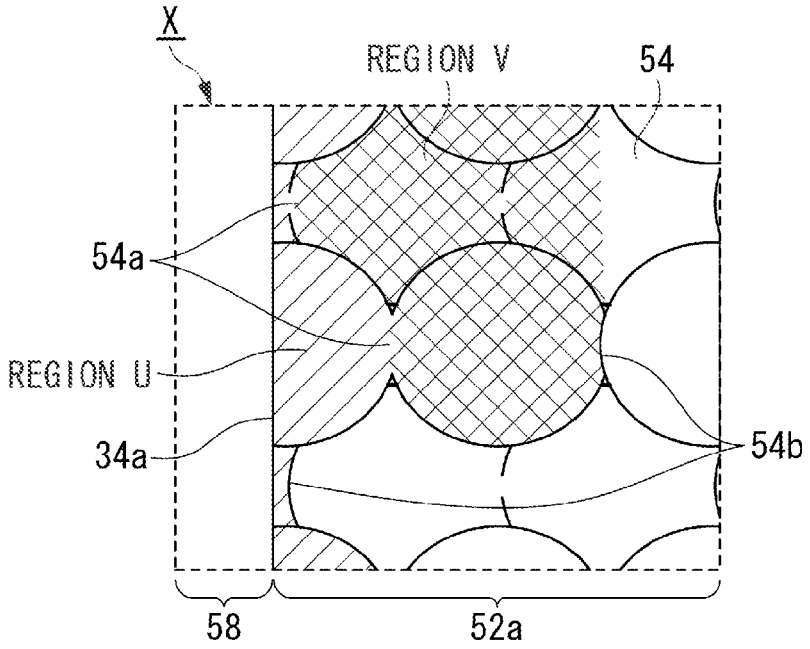
FIGS. 11A and 11B are schematic cross-sectional views illustrating boundary portions between the development edge portion sealing member and an elastic sealing member.
Figure 11B:
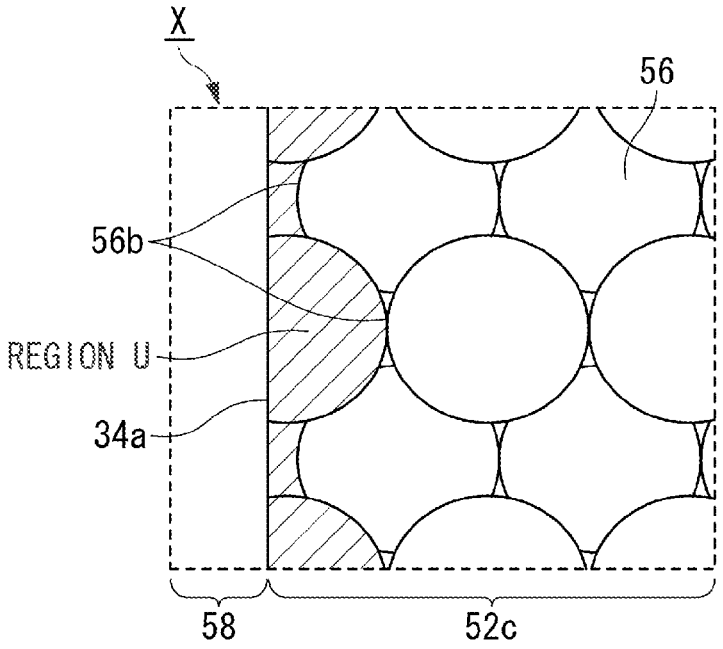

FIG. 11A indicates the boundary portion between the intermediate layer 52 and the elastic sealing member 58 according to the present exemplary embodiment. FIG. 11B illustrates the boundary portion between the elastic sealing member 58 and the intermediate layer 52, which is the aggregate of the independent foam cells with the foam film (e.g., foam cell 56) that are all foam cells as the second comparison example. A region U illustrated in FIGS. 11A and 11B is surrounded by the edge face 34*a* at the developing roller rotation direction upper stream side of the development edge portion sealing member 34 and surfaces of the foam cells in the intermediate layer 52 on the surface configuring the edge face 34*a* at the upper stream side.

The aggregate of the foam cells 56, which is the second comparison example illustrated in FIG. 11B, is the aggregate of the independent foam cells. Therefore, the elastic sealing member 58 is included in the foam cell (region U illustrated in FIG. 11B) forming the surface of the intermediate layer 52, but the elastic sealing member 58 is not included in the foam cell 56 forming the inside of the intermediate layer 52. If the operating life of the development device is made longer, the above-described development edge portion sealing member 34 receives the friction force from the developing roller 6 in the arrow e direction for longer hours, and thus the development edge portion sealing member 34 and the elastic sealing member 58 may peel off from each other.

In contrast, in the intermediate layer 52 according to the present exemplary embodiment illustrated in FIG. 11A, in addition to the region U, the elastic sealing member 58 passes through and infiltrates into the communication hole 54*a* to the inside foam cell 54 indicated in a region V from the communication hole 54*a* included in the foam cell 54 configuring the surface of the edge face 34*a* at the upper stream side. Therefore, at the boundary portion between the edge face 34*a* at the upper stream side and the elastic sealing member 58, a powerful combining force is generated by an anchor effect, and thus even the operating life of the development device is made longer, the development edge portion sealing member 34 and the elastic sealing member 58 are unlikely to peel off from each other.

Further, according to the present exemplary embodiment, the elastic sealing member 58 is inserted before the developing roller 6 illustrated in FIGS. 1A and 1B is mounted. In other words, the elastic sealing member 58 is filled in a state where the intermediate layer 52 is not pressed and the communication hole 54*a* is widely opened. Thus, the elastic sealing member 58 is easily infiltrated from the communication hole 54*a* and the communication hole 54*c* in contact with the edge face 34*a* at the upper stream side of the development edge portion sealing member 34, and the combining force at the boundary portion between the edge face 34*a* at the upper stream side and the elastic sealing member 58 becomes further powerful.

According to the above-described present exemplary embodiment, the urethane foam is adopted, which has air permeability of 10 ml/min to 300 ml/min when the thickness of the intermediate layer 52 is 1.5 mm and the intermediate layer 52 is not pressed in the thickness "t" direction illustrated in FIG. 8, and has the air permeability of 0 ml/min to 200 ml/min when the intermediate layer 52 is pressed to have the thickness of 1.0 mm. An effect of preventing the toner leakage when the elastic sealing member including the above-described intermediate layer 52 is used will be described below. A cartridge P is fixed so that the axis direction of the developing roller 6 is in parallel with the vertical direction. Then, a random shake for generating force, 1.04 times greater than the gravity on average in the vertical direction, is performed for one hour. When the thickness of the intermediate layer is 1.5 mm, the toner may infiltrate into the intermediate layer and leak outside the cartridge P, in the elastic sealing member including the intermediate layer having the air permeability of 500 ml/min or more in a state where the intermediate layer is not pressed in the thickness "t" direction illustrated in FIG. 8. However, when the thickness of the intermediate layer is 1.5 mm, in the elastic sealing member including the intermediate layer having the air permeability of 10 ml/min to 300 ml/min in a state where the intermediate layer is not pressed in the thickness "t" direction illustrated in FIG. 8, the infiltration of the toner into the intermediate layer 52*a* can be reduced, thereby preventing the toner leakage.

The air permeability of the intermediate layer used for the present exemplary embodiment is based on a measurement method described below.

Figure 12:
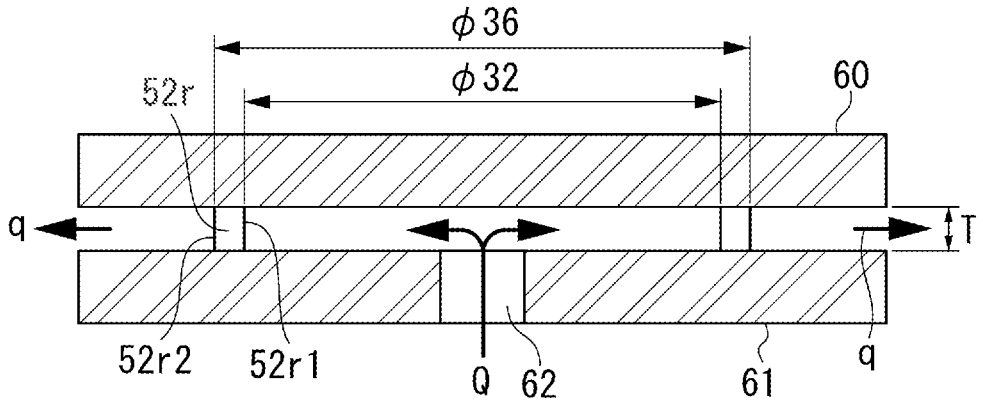
FIG. 12 is a schematic diagram illustrating a method of measuring air permeability.

FIG. 12 is a pattern diagram illustrating the measurement method of the air permeability according to the present exemplary embodiment. There is produced a test piece 52*r* in a ring shape having an inside diameter of 32 mm, an outside diameter of 36 mm, and a thickness of 1.5 mm, using the urethane foam, which is the same material as that of the intermediate layer. The test piece 52*r* is sandwiched by two plates 60 and 61, the air is let from a hole 62 provided in the plate 61 in arrow Q directions at 1.0 kPa, and then an amount of air "q" escaping from an inside diameter side 52*r*1 of the test piece 52*r* to the outside diameter side 52*r*2 thereof for a predetermined time. At this point, while a space between opposite faces of the two plates 60 and 61 is changed in the thickness direction, the amount of air "q" is measured when the test piece having the thickness of 1.5 mm is not pressed, and when pressed to the thickness of 1.0 mm. According to the present exemplary embodiment, the two plates are sandwiched to measure the air permeability, but other methods can be adopted as long as the air is not deflated in the thickness "T" direction of the test pieces.

In other words, based on a certain measurement method, if the foam cell configuring the intermediate layer has the air permeability of 0 ml/min to 200 ml/min when pressed, the toner will not leak due to the intermittent shocks caused by the separating/abutting operation in the image formation, even though the operating life of the development device is made longer. Further, if the foam cell has the air permeability of 10 ml/min to 300 ml/min when not pressed, the elastic sealing member 58 made of the thermal plastic resin melted at a high temperature and the developing blade bottom sealing member 36 are infiltrated into the foam cell forming the intermediate layer 52, thereby combining the foam cells with each other without making any gaps.

As described above, the intermediate layer 52 according to the present exemplary embodiment includes the independent foam cell that is independent with the foam film, the opening foam cell including the opening communication hole that is not to be pressed even when the developing roller 6 is mounted, and the closed foam cell including the closed communication hole that is pressed when the developing roller 6 is mounted. The intermediate layer 52 according to the present exemplary embodiment is the aggregate in which the opening foam cell, the independent foam cell, and the closed foam cell are mixed in a direction from the inside of the development frame member 29 to the outside thereof. The intermediate layer 52 is made as the aggregate of the foam cells so that the development edge portion sealing member 34 and the elastic sealing member 58 can be kept close contact with each other, the toner leakage is reduced, and thus the operating life of the development device can be made longer.

According to the present exemplary embodiment, the configuration is described in which the toner is unlikely to pass through the intermediate layer due to the shock caused by the separating/abutting operation of the developing roller from/on the photosensitive drum, but the effect in the present invention is not limited thereto. For example, in the process cartridge including at least the development device illustrated in FIGS. 3 and 4, when the development device 9 is packaged with the toner storage portion 29*c* filled with the toner and is transported, the similar effects against the shock can be obtained. In other words, the development device is configured such that the toner is unlikely to pass through the intermediate layer due to the shock of shake when transported, thereby preventing the toner from scattering outside the development device during transportation.

As described above, according to the present exemplary embodiment of the present invention, the operating life of the development device can be made longer while the toner leakage is reduced for a long period.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-191479 filed Aug. 31, 2012, which is hereby incorporated by reference herein in its entirety.

What is claimed is:

1. A development device used for an image forming apparatus, the development device comprising:

a frame member;

a developer bearing member configured to develop a latent image formed on an image bearing member using developer; and an edge portion sealing member provided between an edge portion in a rotational axis direction of the developer bearing member and the frame member to prevent the developer from leaking to an outside of the development device from between the edge portion and the frame member, and including a layer that includes an aggregate of a plurality of foam cells in which a foam cell communicating with an adjacent cell via a communication hole and a foam cell not communicating with the adjacent cell are mixed in the rotational axis direction, wherein a recessed portion is formed by a sheet member, the frame member, and the edge portion sealing member, and wherein an elastic sealing member is formed by filing thermal plastic resin into the recessed portion while filling a foam cell communicating with an adjacent cell via the communication hole with the thermal plastic resin.

2. The development device according to claim 1, wherein the sheet member is in contact with the developer bearing member and provided on the frame member; and the elastic sealing member is configured to prevent the developer from leaking to the outside of the development device from among the sheet member, the frame member, and the edge portion sealing member.

3. The development device according to claim 1, wherein the elastic sealing member is formed before the edge portion sealing member is compressed between the edge portion and the frame member.

4. The development device according to claim 1, wherein the face on which the edge portion sealing member and the elastic sealing member are in contact with each other is located at an upper stream side in a direction of a force received by the edge portion sealing member from the rotating developer bearing member.

5. The development device according to claim 1, further comprising:

a layer thickness regulation member configured to regulate a thickness of a layer of the developer carried by the developer bearing member; and a bottom sealing member provided between the layer thickness regulation member and the frame member to prevent the developer from leaking from between the layer thickness regulation member and the frame member, and formed in an integrated manner with the edge portion sealing member.

6. The development device according to claim 5, wherein the bottom sealing member is provided at the downstream side of the edge portion sealing member in the direction of a force received by the edge portion sealing member.

7. A development device used for an image forming apparatus, the development device comprising:

a frame member;

a developer bearing member configured to develop a latent image formed on an image bearing member using developer; and an edge portion sealing member provided between an edge portion in a rotational axis direction of the developer bearing member and the frame member to prevent the developer from leaking to an outside of the development device from between the edge portion and the frame member, and including a layer that includes an aggregate of a plurality of foam cells, wherein, when a test piece in a ring shape formed of a same material as the layer and having an inside diameter of 32 mm, an outside diameter of 36 mm, and a thickness of 1.5 mm, is sandwiched between facing surfaces in a thickness direction in such a manner as to seal a region surrounded by an inside diameter portion of the test piece, and air is let in the region at 1.0 kPa, permeability of an air amount escaping from the inside diameter portion of the test piece to an outside diameter portion thereof is 10 ml/min to 300 ml/min if the thickness of the test piece is 1.5 mm, and 0 ml/min to 200 ml/min if the test piece is pressed to the thickness of 1.0 mm on the facing surfaces.

8. The development device according to claim 7, further comprising:

a sheet member being in contact with the developer bearing member and provided on the frame member; and an elastic sealing member configured to prevent the developer from leaking to the outside of the development device from among the sheet member, the frame member, and the edge portion sealing member.

9. The development device according to claim 8, wherein the elastic sealing member is formed by filling thermal plastic resin into the development device among the sheet member, the frame member, and the edge portion sealing member.

10. The development device according to claim 9, wherein the elastic sealing member is formed before the edge portion sealing member is compressed between the edge portion and the frame member.

11. The development device according to claim 9, wherein a face on which the edge portion sealing member and the elastic sealing member are in contact with each other is located at an upper stream side in a direction of a force received by the edge sealing member from the rotating developer bearing member.

12. The development device according to claim 7, further comprising:

a layer thickness regulation member configured to regulate a thickness of a layer of the developer carried by the developer bearing member; and a bottom sealing member provided between the layer thickness regulation member and the frame to prevent the developer from leaking from between the layer thickness regulation member and the frame member, and formed in an integrated manner with the edge portion sealing member.

13. The development device according to claim 12, wherein the bottom sealing member is provided at a downstream side of the edge portion sealing member in a direction of a force received by the edge portion sealing member.

* * * * *